US009199110B2

(12) United States Patent
Jones

(10) Patent No.: US 9,199,110 B2
(45) Date of Patent: Dec. 1, 2015

(54) MULTI-USER ATHLETIC PERFORMANCE TRAINING APPARATUS

(71) Applicant: Jerry Wayne Jones, Monee, IL (US)

(72) Inventor: Jerry Wayne Jones, Monee, IL (US)

( * ) Notice: Subject to any disclaimer, the term of this patent is extended or adjusted under 35 U.S.C. 154(b) by 473 days.

(21) Appl. No.: 13/624,289

(22) Filed: Sep. 21, 2012

(65) Prior Publication Data

US 2013/0079203 A1 Mar. 28, 2013

Related U.S. Application Data

(60) Provisional application No. 61/538,031, filed on Sep. 22, 2011.

(51) Int. Cl.

| | |
|---|---|
| ***A63B 21/00*** | (2006.01) |
| ***A63B 5/16*** | (2006.01) |
| ***A63B 21/04*** | (2006.01) |
| ***A63B 21/055*** | (2006.01) |
| ***A63B 23/04*** | (2006.01) |
| *A63B 69/00* | (2006.01) |
| *A63B 71/02* | (2006.01) |

(52) U.S. Cl.

CPC ..... *A63B 5/16* (2013.01); *A63B 21/0442* (2013.01); *A63B 21/0552* (2013.01); *A63B 21/1415* (2013.01); *A63B 21/1426* (2013.01); *A63B 23/047* (2013.01); *A63B 69/0028* (2013.01); *A63B 69/0071* (2013.01); *A63B 2071/026* (2013.01); *A63B 2225/107* (2013.01)

(58) Field of Classification Search

USPC ..... 482/124, 121, 74, 130, 142, 95, 96, 482/126, 132, 129, 123

See application file for complete search history.

(56) References Cited

U.S. PATENT DOCUMENTS

| | | | | |
|---|---|---|---|---|
| 3,893,667 | A * | 7/1975 | Snyder et al. | 482/114 |
| 4,863,163 | A * | 9/1989 | Wehrell | 482/123 |
| 4,913,423 | A * | 4/1990 | Farran et al. | 482/130 |
| 4,974,836 | A * | 12/1990 | Hirsch | 482/40 |
| 5,385,525 | A * | 1/1995 | Davis | 482/121 |
| 5,924,966 | A * | 7/1999 | Havlovic | 482/129 |
| 6,228,604 | B1 * | 5/2001 | Escher et al. | 435/25 |
| 8,088,050 | B2 * | 1/2012 | Aucamp | 482/131 |
| 2004/0248713 | A1 * | 12/2004 | Campanaro et al. | 482/123 |
| 2012/0165134 | A1 * | 6/2012 | Jones et al. | 473/417 |

* cited by examiner

*Primary Examiner* — Jerome W Donnelly

(57) ABSTRACT

A Multi-User Athletic Performance Training Apparatus is a flat rectangular exercise platform that utilizes an arrangement of pulleys in combination with resistance bands to allow exercises to be performed, which includes an outer support frame connected to a deck and an inner support frame positioned underneath the deck and within the outer support frame for durability and stability of the platform. The pulleys are arranged on various sides of the top of the platform to allow various configurations of resistance bands to facilitate a wide variety of exercises and training to be performed. The invention also allows up to five people to exercise or train simultaneously, off the four rectangular sides and on the top of the platform. The Multi-User Athletic Performance Training Apparatus also includes eye hooks on the platform for additional resistance band configurations as well as wheel caster supports for easy relocation.

15 Claims, 6 Drawing Sheets

MULTI-USER ATHLETIC PERFORMANCE TRAINING APPARATUS

The current application claims a priority to the U.S. Provisional Patent application Ser. No. 61/538,031 filed on Sep. 22, 2011.

FIELD OF THE INVENTION

The present invention relates generally to exercise. More particularly, the present invention relates to an athletic performance training platform that can accommodate multiple users simultaneously.

BACKGROUND OF THE INVENTION

Sport is generally defined as all forms of competitive physical activity which, through casual or organized participation, aim to use, maintain or improve physical ability and provide entertainment to participants. Hundreds of sports exist, from those requiring only two participants, to sports which involve hundreds of simultaneous participants, either in teams or competing as individuals. Sport is generally recognized as activities which are based in physical athleticism or physical dexterity, and sports are usually governed by a set of rules or customs which serve to ensure fair competition and consistent judgment of the winner.

Participants in sports are known as athletes. In order to reach and preserve a level of athletic performance that allows an athlete to remain competitive with or achieve athletic superiority over their opponents, athletes must keep a rigorous exercise regimen to gain and maintain certain levels of strength, agility, endurance, and other aspects of fitness. Training one's body for agility and endurance can be time-consuming and difficult. Also, such training is often done alone, which can be detrimental to athletes in team sports. It is therefore an object of the present invention to present a multi trainer performance board which can accommodate multiple users at one time for exercising and training. The present invention is designed to provide agility, endurance and specific sport maneuvering training for not only athletes but also the average weekend warrior, trainers, or coaches.

The present invention is nicknamed "The Beast." It is an athletic performance training machine designed to aid athletes or the average weekend warrior in increasing such traits as vertical leap, quickness, agility, explosiveness, strength, and cardio muscle endurance. It is also designed to be team oriented, since it has the capacity to accommodate up to five people training simultaneously. The present invention utilizes resistance bands that connect to the ankles, wrist and waist to contract specific fast-twitch muscle fibers. Fast twitch fibers are the major muscles needed for an athlete to establish quickness, explosiveness, stability and balance. If an athlete does not have strong fast twitch muscles, their athletic ability is limited and they will not be able to compete on the same level as more highly skilled athletes. The present invention seeks to aid athletes in building those fast twitch muscles, making an athlete stronger, more responsive and more efficient.

The present invention is a self-motion machine, which means that the person exercising on it controls the motion of the workout and increased effort given results in greater range of motion and resistance. This facilitates practicing maneuvers for specific sports, such as defensive moves or shooting for basketball, off the line blocking and lateral cutting for football, or spiking and lateral movement for volleyball. Since the present invention incorporates resistance bands, a wide variety of exercises can be performed, such as the previously mentioned maneuvers in addition to exercises such as shoulder presses, arm curls, leg raises, and rows, as well as being used in combination with a treadmill, pulling the user downwards toward the treadmill deck, making the user exert more effort to maintain a steady pace on the treadmill and resulting in a more strenuous workout.

DETAIL DESCRIPTIONS OF THE INVENTION

Figure 1:
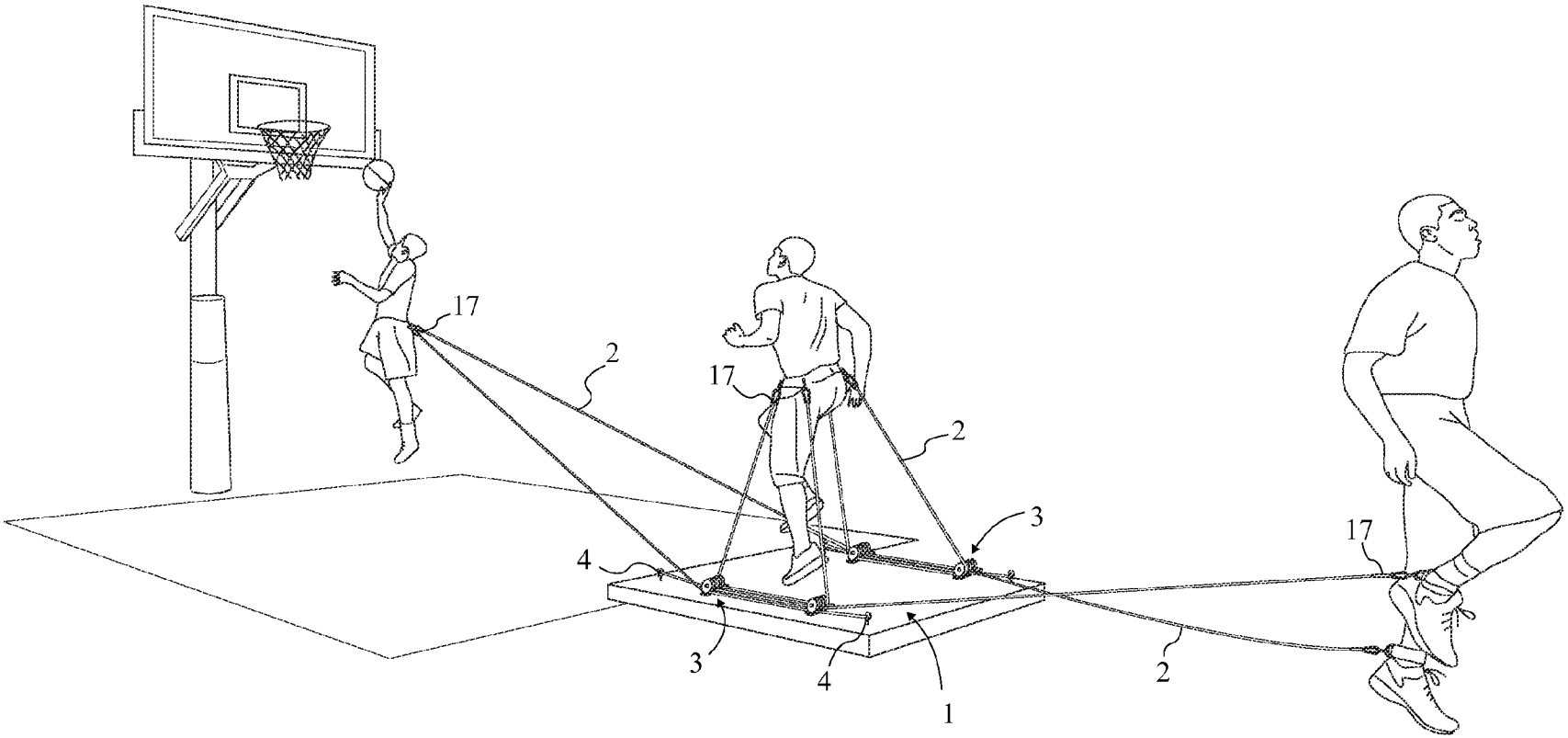
FIG. 1 is a perspective view of the present invention being used by three athletes to train in various ways.

All illustrations of the drawings are for the purpose of describing selected versions of the present invention and are not intended to limit the scope of the present invention.

The present invention is a multi-user athletic performance training apparatus. Referring to FIGS. 1-5, the present invention comprises a platform 1, a plurality of resistance bands 2, a plurality of pulleys 3, a plurality of eye bolts 4, and a plurality of casters 5. The platform 1 comprises a deck 6, a mat 7, an outer support frame 8, and an inner support frame 9. The plurality of pulleys 3 is positioned atop the deck 6, and the plurality of resistance bands 2 is removably engaged with the plurality of pulleys 3. In the preferred embodiment of the invention, multiple of the plurality of resistance bands 2 can be used simultaneously with each of the plurality of pulleys 3.

The deck 6 is a rectangular board that supports an athlete performing exercises in addition to the plurality of pulleys 3, the plurality of resistance bands 2 and the plurality of eye bolts 4. The deck 6 is adjacently positioned above the inner support frame 9, which provides a framework that supports the deck 6 and protects it from damage due to jumping exercises being performed atop the present invention. In the preferred embodiment of the present invention, the outer support frame 8 and inner support frame 9 are rectangularly shaped. The outer support frame 8 is perimetrically connected to the deck 6, and the top sides of the outer support frame 8 and the deck 6 are vertically level with each other. The inner dimensions of the outer support frame 8, the dimensions of the deck 6, and the outer dimensions of the inner support frame 9 are preferably the same. The outer support frame 8 is concentrically positioned around the inner support frame 9. The mat 7 is preferably made of rubber and concentrically connected atop the deck 6 and functions to provide grip, stability and impact absorption to an athlete performing exercises atop the present invention.

Figure 5:
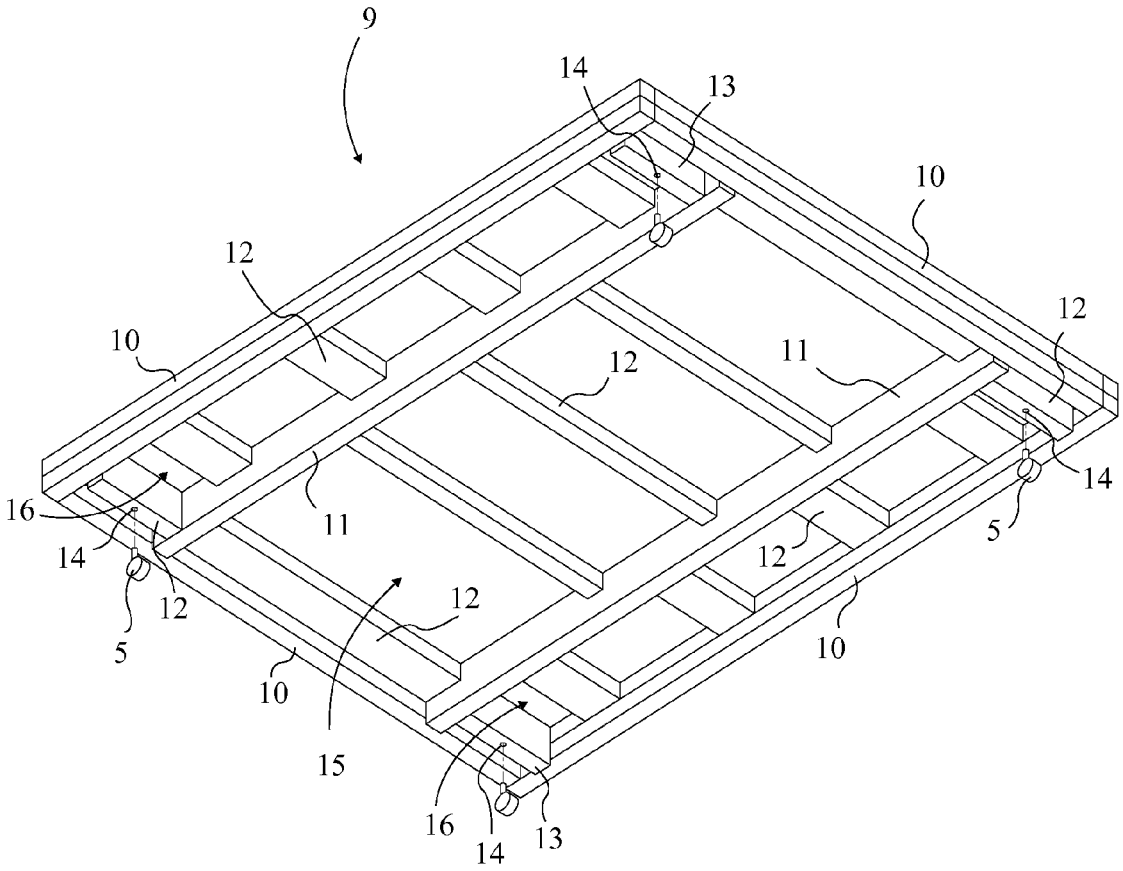
FIG. 5 is a bottom perspective view of the inner support frame showing the arrangement of the supports of the inner support frame according to the preferred embodiment of the present invention.
Figure 6:
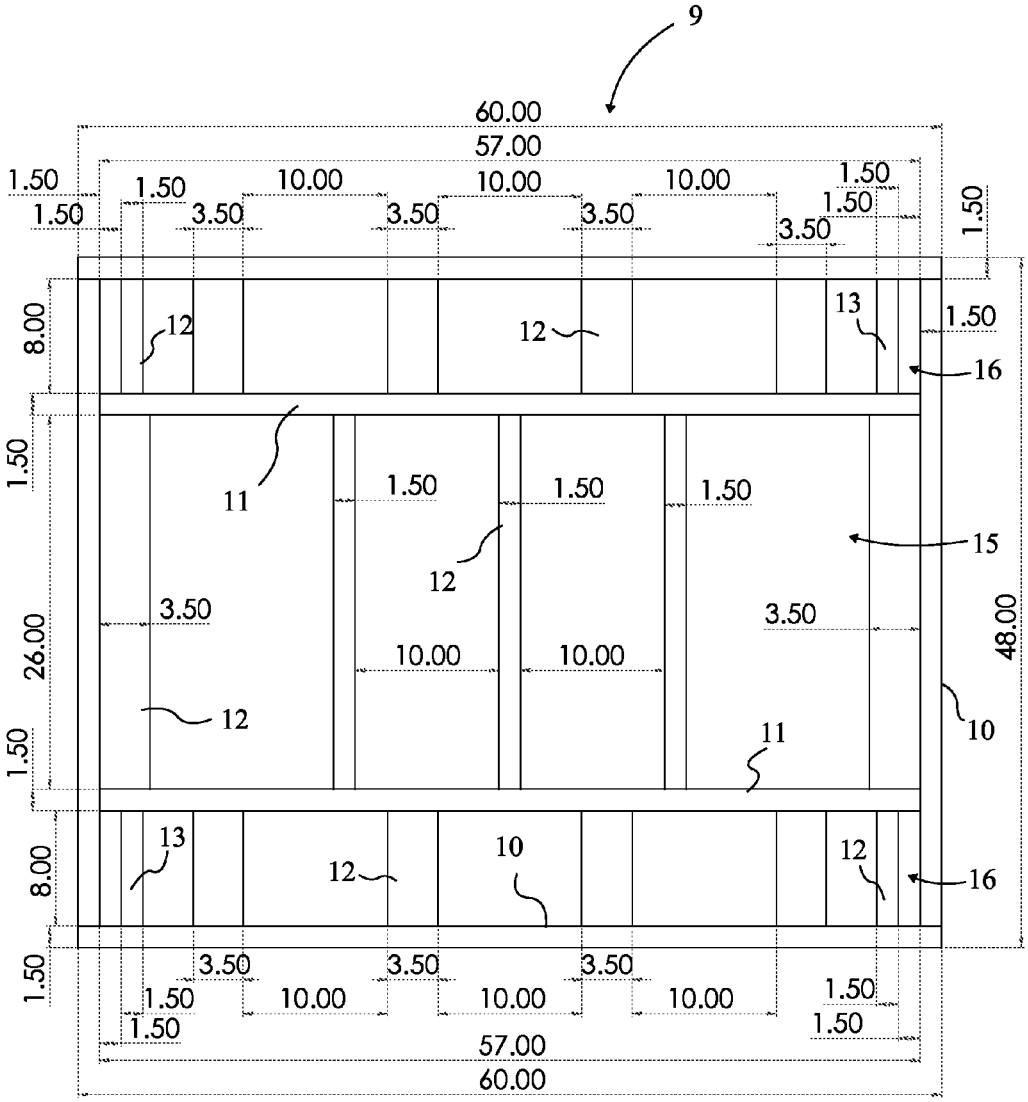
FIG. 6 is a top view of the inner support frame showing the arrangement and dimensions in inches of the supports of the inner support frame according to the preferred embodiment of the invention.

Referring to FIGS. 5-6, the inner support frame 9 comprises perimeter supports 10, primary supports 11, and secondary supports 12. The primary supports 11 are perpendicularly connected to the secondary supports 12, and the primary supports 11 and secondary supports 12 are positioned within the perimeter supports 10. The secondary supports 12 comprise at least four feet supports 13, which are positioned at the corners of the inner support frame 9 at equal radial distances from the center of the inner support frame 9. Each of the at least four feet supports 13 comprises a caster receiving hole 14. Each of the plurality of casters 5 may be removably connected within a caster receiving hole 14 so that the present invention may be moved from one location to another more easily.

Figure 4:
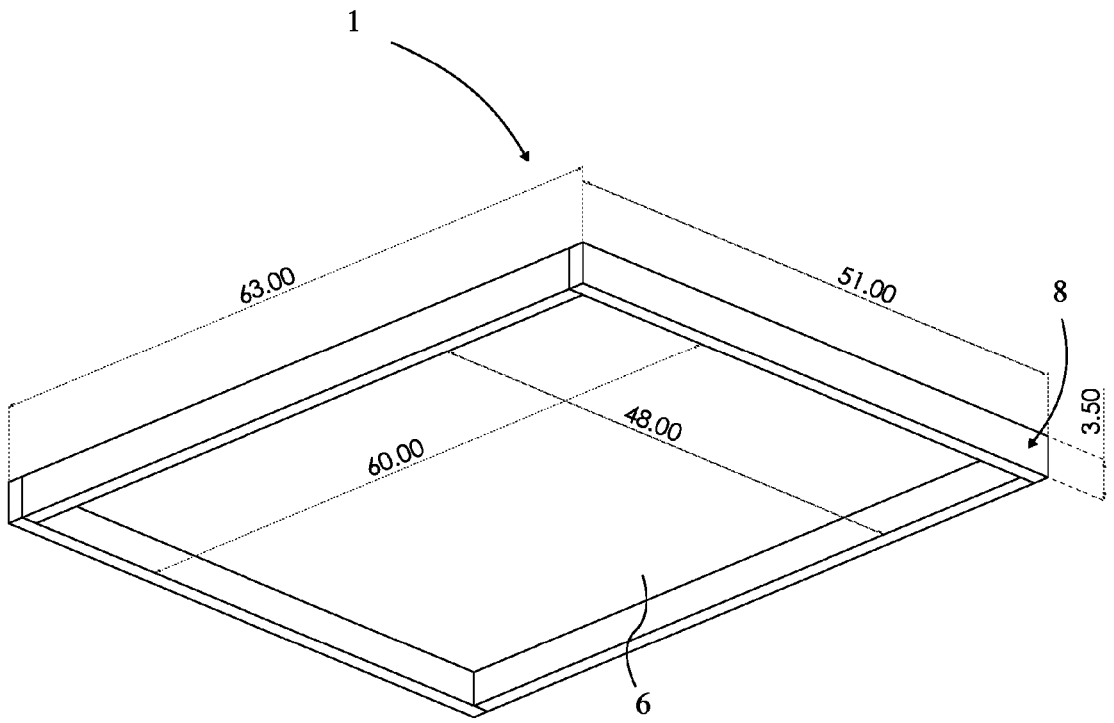
FIG. 4 is a bottom perspective view of the outer support frame and deck of the present invention showing the dimensions in inches of the preferred embodiment of the present invention.

The following description is to demonstrate the spirit of the preferred embodiment of the present invention and is not intended to limit the frame arrangement or dimensions of the present invention. Referring to FIGS. 4-6, the deck 6 is preferably a ⅝ inch thick wooden board. The outer support frame 8 and inner support frame 9 are preferably comprised of wooden beams. The mat 7 is preferably ⅜ inch thick and made of rubber. The width of the outer support frame 8 is 63 inches, and the length of the outer support frame 8 is 51 inches. The depth of the outer support frame 8 is 3.5 inches. The width of the deck 6 and the width of the inner support frame 9 are both 60 inches, and the length of the deck 6 and the length of the inner support frame 9 are both 48 inches. The perimeter supports 10 of the inner support frame 9 define the outer width and length of the inner support frame 9. The inner width of the inner support frame 9 is 57 inches, and the inner length of the inner support frame 9 is 45 inches. The outer support frame 8 and the perimeter supports 10 of the inner support frame 9 are 1.5 inches thick. The perimeter supports 10 are 3 inches deep.

There are two primary supports 11 of the inner support frame 9 that are oriented parallel to the width of the inner support frame 9 and divide the length of the inner support frame 9 into three rectangular sections. The middle section 15 is 26 inches long, and the outer sections 16 are both 8 inches long. The primary supports 11 are each 1.5 inches long and 3.5 inches deep. The secondary supports 12 of the inner support frame 9 are oriented perpendicular to the primary supports 11 and parallel to the length of the inner support frame 9. The middle section 15 defined by the primary supports 11 is symmetric about the width and length of the inner support frame 9 and comprises three 1.5 inch wide by 1.5 inch deep by 26 inch long secondary supports 12 spaced 10 inches from each other, perpendicularly connected on either end to the primary supports 11 and positioned symmetrically about the middle of the width of the deck 6, providing support to the central portion of the deck 6. There are also two 3.5 inch wide by 1.5 inch deep by 26 inch long secondary supports 12 at both ends of the middle section 15, perpendicularly connected to the primary supports 11 and adjacently positioned to the perimeter supports 10 that define the length of the inner support frame 9. The outer sections 16 of the inner support frame 9 defined by the primary supports 11 are symmetric about both the width and length of the inner support frame 9 and comprise four 3.5 inch wide by 8 inch long by 1.5 inch deep secondary supports 12 spaced 10 inches apart from each other symmetric along the length of the inner support frame 9. The at least four feet supports 13 are secondary supports 12 that are 1.5 inches wide by 8 inches long by 3.5 inches deep and are positioned at each corner of the inner support frame 9 approximately 1 to 3 inches from the perimeter supports 10 that define the length of the inner support frame 9. This specific embodiment of the dimensions and arrangement of the inner support frame 9, outer support frame 8 and deck 6 is disclosed only as the preferred embodiment of the present invention. Alternate embodiments of the invention may comprise different arrangements, dimensions or shapes of the inner support frame 9, outer support frame 8, and deck 6.

Figure 2:
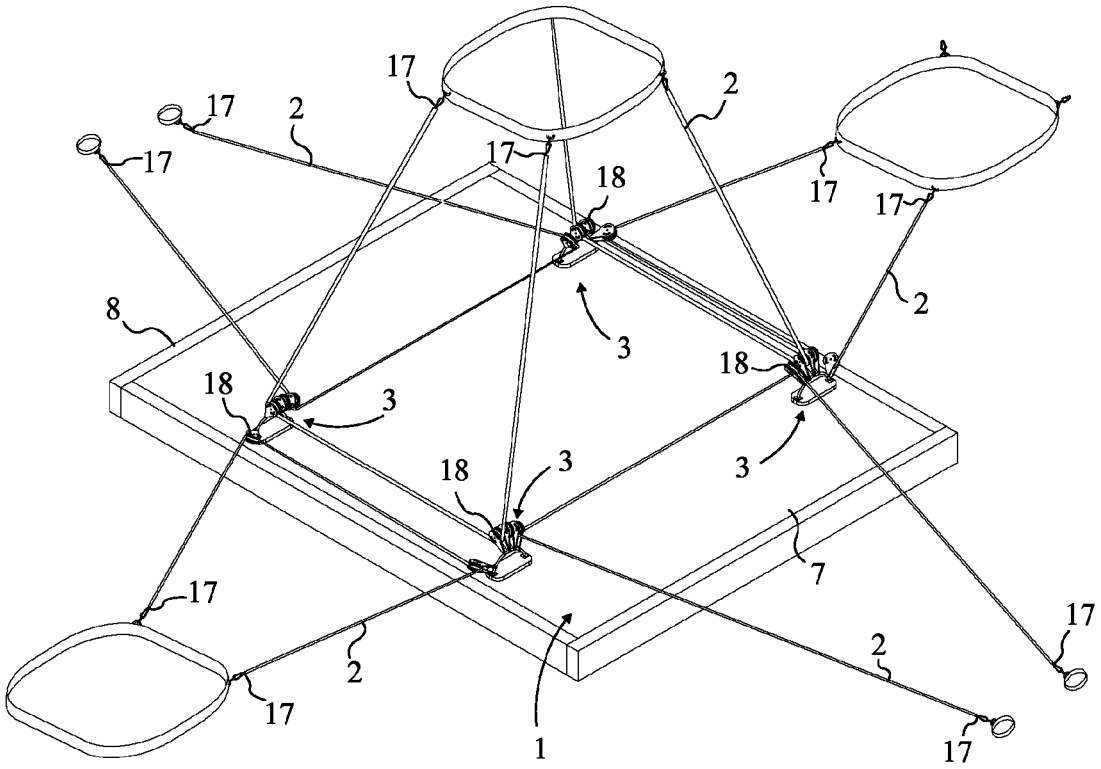
FIG. 2 is a perspective view of a first embodiment of the present invention showing one configuration of pulleys and resistance bands.
Figure 3:
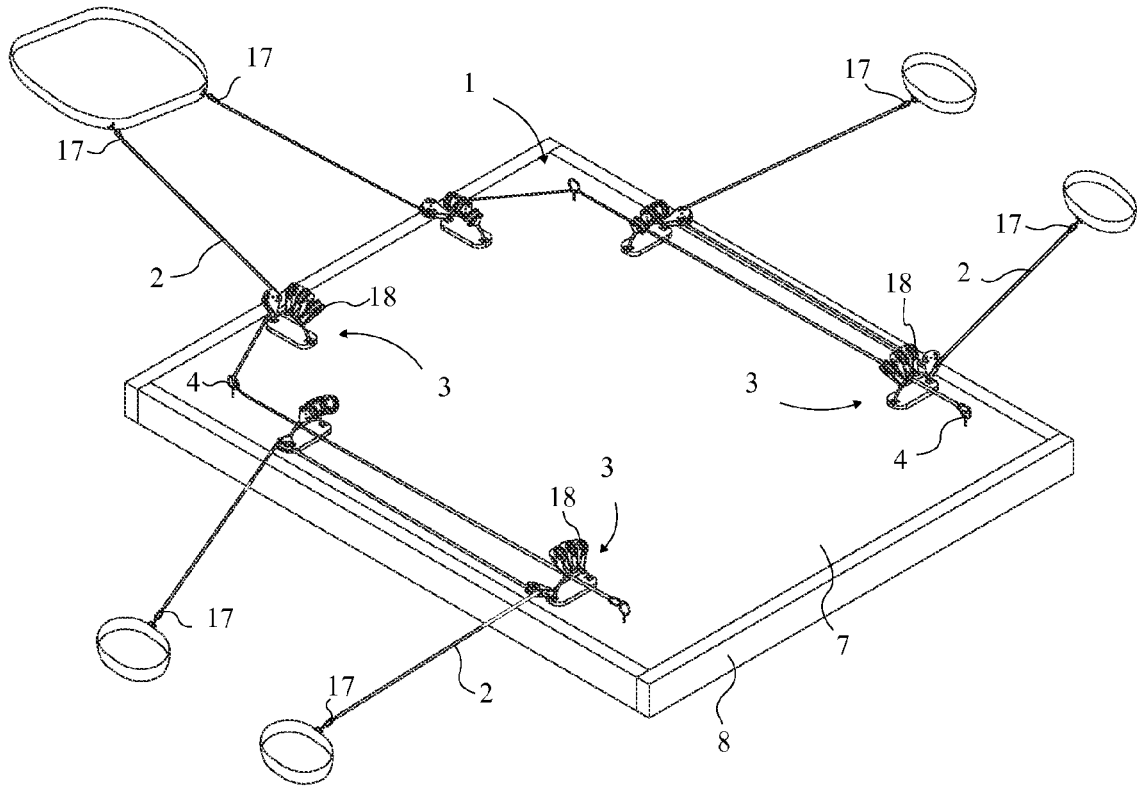
FIG. 3 is a perspective view of a second embodiment of the present invention showing another configuration of pulleys and resistance bands.

Referring to FIGS. 1-3, the plurality of pulleys 3 are oppositely positioned to each other atop the deck 6. The plurality of pulleys 3 may be removably connected to the inner support frame 9 through the mat 7 and the deck 6, preferably utilizing nuts, bolts, and mounting brackets. Each of the plurality of pulleys 3 comprises a plurality of pulley wheels 18. In the preferred embodiment of the present invention, two of the plurality of pulleys 3 are mounted per each side of the deck 6. On each side, the plurality of pulleys 3 forms a line parallel to their respective side of the deck 6, facilitating the engagement of the plurality of resistance bands 2 with the plurality of pulleys 3 such that each side can simultaneously accommodate an athlete for training. On each side, the plurality of pulleys 3 is spaced apart from each other, approximately shoulder width, so that the direction of the force to be applied to the plurality of resistance bands 2 to exercise is oriented appropriately for correctly performing desired exercises. In the preferred embodiment of the invention, each of the plurality of pulleys 3 comprises four pulley wheels 18, allowing for four of the plurality of resistance bands 2 to be engaged with each of the plurality of pulleys 3 for a variety of methods and configurations of utilizing the plurality of resistance bands 2 for exercising. In the preferred embodiment of the invention, the pulley wheels 18 may also swivel about one or more rotational axes in order to appropriately accommodate the various different angles and orientations the plurality of resistance bands 2 encounters during different exercises and movements. In an alternate embodiment of the invention, the positions of the plurality of pulleys 3 are able to be adjusted along the deck 6, either by having multiple holes for mounting the plurality of pulleys 3 with nuts and bolts, by having the plurality of pulleys 3 on a sliding track that may be affixed in a desired location, or another adjustment method.

Each of the plurality of resistance bands 2 comprises at least two connectors 17. The at least two connectors 17 are connected to each of the plurality of resistance bands 2 at the opposite extremities of the resistance bands to facilitate their use for performing exercises. Preferably, the at least two connectors 17 comprise loops of material such as strong fabric or plastic so that the plurality of resistance bands 2 may be connected to appropriate exercising equipment utilizing quick connect latches or carabiners, such as handles, rings, bars, wrist or ankle bands, or waist belts. Preferably, the at least two connectors 17 can rotate about axes passing perpendicularly into the extremities of each of the plurality of resistance bands 2.

The plurality of eye bolts 4 are oppositely positioned from each other atop the mat 7 and are removably connected to the deck 6 through the mat 7. In the preferred embodiment of the invention, the eye bolts are positioned proximate to the corners of the platform 1. The plurality of resistance bands 2 may be removably placed within the plurality of eye bolts 4. The plurality of eye bolts 4 are used to facilitate specific configurations of the plurality of resistance bands 2 in order prevent damage to the plurality of resistance bands 2, to adjust the resistance of the plurality of resistance bands 2, or to otherwise adjust the configuration of the plurality of resistance bands 2.

The preferred embodiment of the invention includes accessories for facilitating different exercises such as, but not limited to, a heavy duty padded belt, wrist and ankle straps, grip handles, a straight bar, a squat bench, and hooks or clips to attach the accessories to the plurality of resistance bands 2.

Although the invention has been explained in relation to its preferred embodiment, it is to be understood that many other possible modifications and variations can be made without departing from the spirit and scope of the invention as hereinafter claimed.

What is claimed is:

1. A multi-user athletic performance training apparatus comprises:

a platform;

a plurality of resistance bands;

a plurality of pulleys;

a plurality of eye bolts;

the platform comprises a deck;

the plurality of pulleys being positioned atop the deck;

the plurality of pulleys being distributed across the deck;

the plurality of resistance bands being removably engaged with the plurality of pulleys;

the plurality of eye bolts being distributed across the deck amongst the plurality of pulleys; and the plurality of eye bolts being removably connected to the deck.

2. The multi-user athletic performance training apparatus as claimed in claim 1 comprises:

the platform further comprises a mat, an outer support frame, and an inner support frame;

the deck being adjacently positioned atop the inner support frame;

the outer support frame being concentrically positioned around the inner support frame;

the outer support frame being perimetrically connected to the deck;

the mat being connected atop the deck; and the plurality of pulleys being removably connected to the inner support frame through the mat and the deck.

3. The multi-user athletic performance training apparatus as claimed in claim 2 comprises:

the inner support frame comprises perimeter supports, primary supports, and secondary supports;

the primary supports and the secondary supports being positioned within the perimeter supports; and the primary supports being perpendicularly connected to the secondary supports.

4. The multi-user athletic performance training apparatus as claimed in claim 3 comprises:

a plurality of casters;

the secondary supports comprise at least four feet supports;

the at least four feet supports being radially positioned to each other;

each of the at least four feet supports comprises a caster receiving hole; and the plurality of casters being removably connected within the caster receiving holes.

5. The multi-user athletic performance training apparatus as claimed in claim 1 comprises:

each of the plurality of resistance bands comprises at least two connectors; and the at least two connectors being connected at opposite extremities of their respective resistance band.

6. The multi-user athletic performance training apparatus as claimed in claim 1 comprises:

the plurality of resistance bands being removably positioned within the plurality of eye bolts.

7. A multi-user athletic performance training apparatus comprises:

a platform;

a plurality of resistance bands;

a plurality of pulleys;

a plurality of eye bolts;

a plurality of exercise equipment pieces;

the platform comprises a deck;

the plurality of pulleys being positioned atop the deck;

the plurality of pulleys being distributed across the deck;

the plurality of resistance bands being removably engaged with the plurality of pulleys;

the plurality of eye bolts being distributed across the deck amongst the plurality of pulleys;

the plurality of eye bolts being removably connected to the deck;

each of the plurality of resistance bands comprises at least two connectors;

the at least two connectors being connected to at opposite extremities of their respective resistance band;

the plurality of resistance bands being removably positioned within the plurality of eye bolts; and the plurality of exercise equipment pieces being removably attached to the at least two connectors for each of the plurality of resistance bands.

8. The multi-user athletic performance training apparatus as claimed in claim 7 comprises:

the platform further comprises a mat, an outer support frame, and an inner support frame;

the deck being adjacently positioned atop the inner support frame;

the outer support frame being concentrically positioned around the inner support frame;

the outer support frame being perimetrically connected to the deck;

the mat being connected atop the deck;

the plurality of pulleys being removably connected to the inner support frame through the mat and the deck; and the plurality of eyebolts being removably connected to the deck through the mat.

9. The multi-user athletic performance training apparatus as claimed in claim 8 comprises:

a plurality of casters;

the inner support frame comprises perimeter supports, primary supports, and secondary supports;

the primary supports and the secondary supports being positioned within the perimeter supports;

the primary supports being perpendicularly connected to the secondary supports;

the secondary supports comprise at least four feet supports;

the at least four feet supports being radially positioned to each other;

each of the at least four feet supports comprises a caster receiving hole; and the plurality of casters being removably connected within the caster receiving holes.

10. A multi-user athletic performance training apparatus comprises:

a platform;

a plurality of resistance bands;

a plurality of pulleys;

a plurality of eye bolts;

a plurality of exercise equipment pieces;

the platform comprises a deck, a mat, an outer support frame, and an inner support frame;

the plurality of pulleys being positioned atop the deck;

the plurality of pulleys being distributed across the deck;

the plurality of resistance bands being removably engaged with the plurality of pulleys;

the plurality of eye bolts being distributed across the deck amongst the plurality of pulleys;

the plurality of eye bolts being removably connected to the deck;

the deck being adjacently positioned atop the inner support frame;

the outer support frame being concentrically positioned around the inner support frame;

the outer support frame being perimetrically connected to the deck;

the mat being connected atop the deck;

the plurality of pulleys being removably connected to the inner support frame through the mat and the deck;

each of the plurality of resistance bands comprises at least two connectors;

the at least two connectors being connected at opposite extremities of their respective resistance band; and the plurality of exercise equipment pieces being removably attached to the at least two connectors for each of the plurality of resistance bands.

11. The multi-user athletic performance training apparatus as claimed in claim 10 comprises:

a plurality of casters;

the inner support frame comprises perimeter supports, primary supports, and secondary supports;

the primary supports and the secondary supports being positioned within the perimeter supports;

the primary supports being perpendicularly connected to the secondary supports;

the secondary supports comprise at least four feet supports;

the at least four feet supports being radially positioned to each other;

each of the at least four feet supports comprises a caster receiving hole; and the plurality of casters being removably connected within the caster receiving holes.

12. The multi-user athletic performance training apparatus as claimed in claim 11 comprises:

the plurality of resistance bands being removably positioned within the plurality of eye bolts.

13. The multi-user athletic performance training apparatus as claimed in claim 2 comprises:

the plurality of eyebolts being removably connected to the deck through the mat.

14. The multi-user athletic performance training apparatus as claimed in claim 5 comprises:

a plurality of exercise equipment pieces; and the plurality of exercise equipment pieces being removably attached to the at least two connectors for each of the plurality of resistance bands.

15. The multi-user athletic performance training apparatus as claimed in claim 10 comprises:

the plurality of eyebolts being removably connected to the deck through the mat.

* * * * *